US008052782B2

(12) United States Patent
Mochizuki et al.

(10) Patent No.: US 8,052,782 B2
(45) Date of Patent: Nov. 8, 2011

(54) STRUCTURE FOR ATTACHING DUST COLLECTION ELECTRODE OF WET ELECTRIC DUST COLLECTOR

(75) Inventors: Yoshihiko Mochizuki, Tokyo (JP); Naoyuki Ohashi, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 369 days.

(21) Appl. No.: 12/382,396

(22) Filed: Mar. 16, 2009

(65) Prior Publication Data

US 2009/0235821 A1 Sep. 24, 2009

(30) Foreign Application Priority Data

Mar. 24, 2008 (JP) ..... 2008-075844
Mar. 13, 2009 (JP) ..... 2009-060858

(51) Int. Cl.
*B03C 3/40* (2006.01)

(52) U.S. Cl. ..... 96/83; 96/89; 96/92; 313/292

(58) Field of Classification Search ..... 96/43, 50, 96/52, 53, 83, 86, 87, 89, 92; 313/292, 311
See application file for complete search history.

(56) References Cited

U.S. PATENT DOCUMENTS 2,532,734 A * 12/1950 Schmidt ..... 96/92
3,729,815 A * 5/1973 Quintilian et al. ..... 29/592.1
4,240,810 A * 12/1980 Frauenfelder ..... 96/86
4,508,547 A * 4/1985 Seufert ..... 96/92
4,516,992 A * 5/1985 Jonelis ..... 96/87
5,366,540 A * 11/1994 Bojsen ..... 96/33
5,665,147 A * 9/1997 Taylor et al. ..... 96/72
5,725,638 A * 3/1998 Cross et al. ..... 96/71
6,048,385 A * 4/2000 Koide ..... 96/83
6,096,119 A * 8/2000 Ho et al. ..... 96/79
6,579,349 B1 * 6/2003 Ting et al. ..... 96/44
7,468,094 B2 * 12/2008 Hendricksen ..... 95/57
2005/0045038 A1 * 3/2005 Huang ..... 96/83

FOREIGN PATENT DOCUMENTS

JP 4-322757 A * 11/1992 ..... 96/87
JP A-6-154652 6/1994
JP A-2000-189836 7/2000

* cited by examiner

*Primary Examiner* — Richard L Chiesa
(74) *Attorney, Agent, or Firm* — Oliff & Berridge, PLC

(57) ABSTRACT

A structure for attaching a dust collection electrode of a wet electric dust collector that is low-cost and resistant to entire face corrosion, space corrosion, and hole corrosion. An end of a dust collection electrode element is tightened and slung to be supported by a slung beam slung in a lateral direction in a building accommodating a dust collection apparatus. A supporting member made of Hastelloy® is attached to the dust collection electrode element. The supporting member and the slung beam include attachment holes through which the supporting member and the slung beam are tightened together by a bolt and nut. The slung beam and the dust collection electrode element have therebetween the supporting member to sling and support the slung beam and the dust collection electrode plate so that the slung beam and the dust collection electrode plate are separated from each other.

8 Claims, 7 Drawing Sheets

STRUCTURE FOR ATTACHING DUST COLLECTION ELECTRODE OF WET ELECTRIC DUST COLLECTOR

BACKGROUND OF THE INVENTION (a) Field of the Invention

The present invention relates to a structure for attaching a dust collection electrode of a wet electric dust collector. In particular, the present invention relates to a structure for attaching dust collection electrodes of a wet electric dust collection apparatus that prevents the corrosion in a low pH environment by the cleaning by cleaning water for removing dust or the like collected and attached as the dust collector operates.

(b) Description of the Related Art

An electric dust collector is designed so that a discharge electrode and a dust collection electrode are alternately arranged so that exhaust gas passes therebetween to electrically-charge microparticles (dust) in the exhaust gas by electric discharge to allow the dust to be trapped by the dust collection electrode. As the dust collector operates, dust or the like is collected and attached around the dust collection electrode of the dust collector. When sulfur components are mixed in exhaust gas passing through the dust collector, a risk is caused where these sulfur components turn into sulfur oxides that are attached to the dust collector to corrode the dust collector. Generally, the trapped dust or the like is removed by spraying cleaning water to the dust collection electrode of the wet electric dust collector. When the cleaning is always performed, the acceleration of the corrosion in the dust collector is prevented by maintaining a high pH of the mist of the cleaning water. When the cleaning is performed intermittently however, the trapped dust is attached to the dust collector for a long time and the dust collector must operate in a harsh corrosion environment where the mist of the cleaning water has a pH value of 0.5.

The wet electric dust collector is also designed so that discharge electrodes are opposed to dust collection electrode plates to which dust or the like is attached. The dust collection electrode plates are arranged in a plane in a longitudinal direction. Upper and lower ends are connected to slung beams via a tightening member to sling and maintain the upper and lower ends. The dust collection electrodes and the slung beams are supported by a structure in which the dust collection electrodes and the slung beams include attachment holes through which bolts are inserted to tighten the upper and lower ends. Due to this supporting structure, spaces and holes are formed among the dust collection electrodes, the slung beams, and the supporting structure. If mist of the cleaning water having a low pH value enters the spaces or the holes, the corrosion is promoted. Thus, this must be prevented effectively. This type of wet electric dust collector for removing dust or the like that is attached to dust collection electrodes is disclosed in Patent Document 1 and Patent Document 2.

[Patent Document 1] Japanese Published Unexamined Patent Application No. H6-154652

[Patent Document 2] Japanese Published Unexamined Patent Application No. 2000-189836

It is an objective of the present invention to provide a structure for attaching a dust collection electrode of a wet electric dust collector according to which spaces and holes located among the dust collection electrodes, the slung beams, and the supporting structure as well as the characteristics of the materials are taken into consideration so that the structure is low-cost and resistant to all kinds of corrosions of entire face corrosion, space corrosion, and hole corrosion.

SUMMARY OF THE INVENTION

A wet electric dust collector is structured so that dust collection electrodes to which dust or the like is attached and slung beam from which dust collection electrodes are slung are connected via the supporting structure. In order to prevent the corrosion due to the mist of the cleaning water having a low pH, the selection of the materials is important. A dust collection electrode plate is generally made of stainless material (super stainless NAS254N made of Nippon Yakin Kogyo Co., Ltd.). This stainless material has a characteristic in which the material is resistant to the entire face corrosion and is weak to the space corrosion and the hole corrosion. To solve this, Hastelloy® has been known as material that is resistant to the entire face corrosion, the space corrosion, and the hole corrosion, and a dust collection electrode plate made of Hastelloy has been considered as being able to improve problems such as the space corrosion. However, Hastelloy is disadvantageous in that the cost is generally high. The present invention solves this disadvantage by a configuration in which only a portion at which a slung beam of a dust collection electrode has a contact with dust collection electrode element made of super stainless is made of Hastelloy. The element made of super stainless may be joined to the supporting member made of Hastelloy by welding.

Specifically, a structure for attaching a dust collection electrode of a wet electric dust collector according to the present invention is a structure for attaching a dust collection electrode of a wet electric dust collector in which an end of a dust collection electrode plate made of super stainless material is tightened at and is slung to be supported by a slung beam slung in a lateral direction in a building accommodating a dust collection apparatus. A supporting plate made of Hastelloy® is attached to the dust collection electrode plate. This supporting plate and the slung beam include attachment holes through which the supporting plate and the slung beam are tightened together via the attachment holes to sling and support the dust collection electrode plate by the slung beam so that the slung beam and the dust collection electrode plate have therebetween the Hastelloy-made supporting plate so as to separate the slung beam and the dust collection electrode plate from each other.

The interior of the dust collector is subjected by the trap dust to the mist of the cleaning water having a low pH value. Specifically, the entire face of the dust collection electrode is subjected to the mist. According to the present invention, the dust collection electrode plate is made of super stainless material and thus is resistant to the entire face corrosion. Thus, the entire face corrosion can be prevented. The dust collection electrode plate also may be made of material other than super stainless material. However, stainless material having an effect for preventing the entire face corrosion is desired. On the other hand, with regard to the dust collection electrode, portions at which the slung beam is joined to the supporting structure are subjected to the mist of the cleaning water, respectively. Since the supporting member including the attachment holes is made of Hastelloy and thus is resistant to the space corrosion and hole corrosion, the respective spaces and holes can be prevented from being corroded. Thus, all of the entire face corrosion, space corrosion, and hole corrosion can be prevented. Furthermore, since high-cost Hastelloy is used only in the supporting plate having a contact with the slung beam. Therefore, high-cost Hastelloy can be used in a smaller amount, thus reducing the manufacture cost. The slung beam itself also can be made of Hastelloy to provide a dust collector having a higher effect of preventing corrosion.

DETAILED DESCRIPTION OF THE PREFERRED EMBODIMENTS

Figure 1:
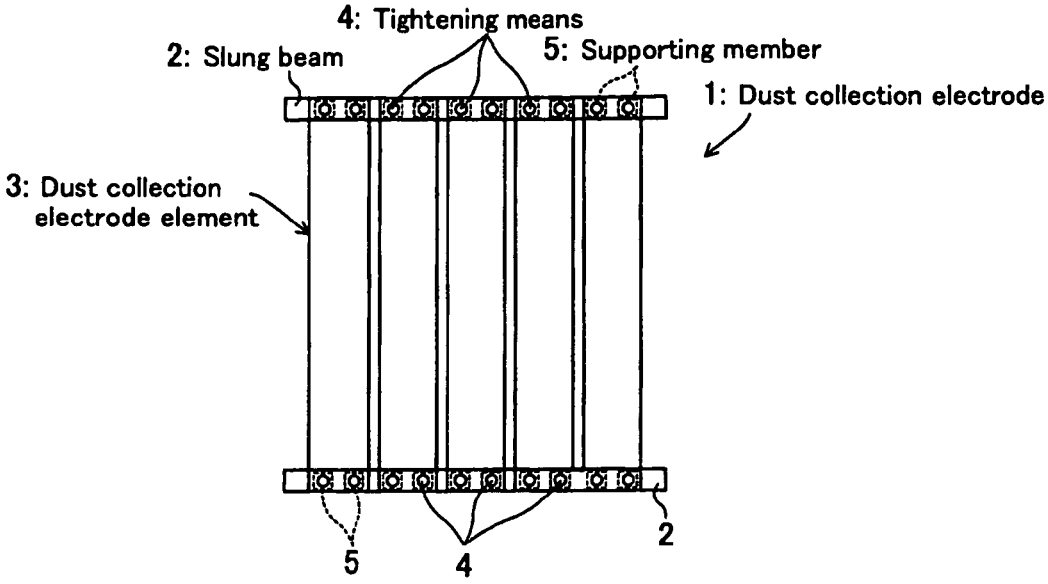
FIG. 1 is a front view of the entirety of a dust collector attachment structure according to the first embodiment.
Figure 2:
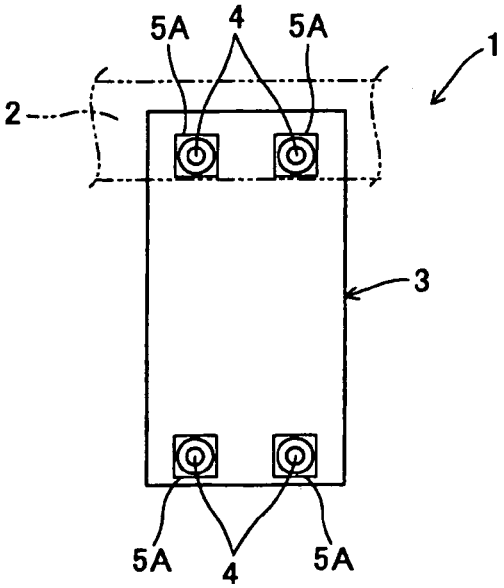
FIG. 2 is a partial front view of FIG. 1.
Figure 3:
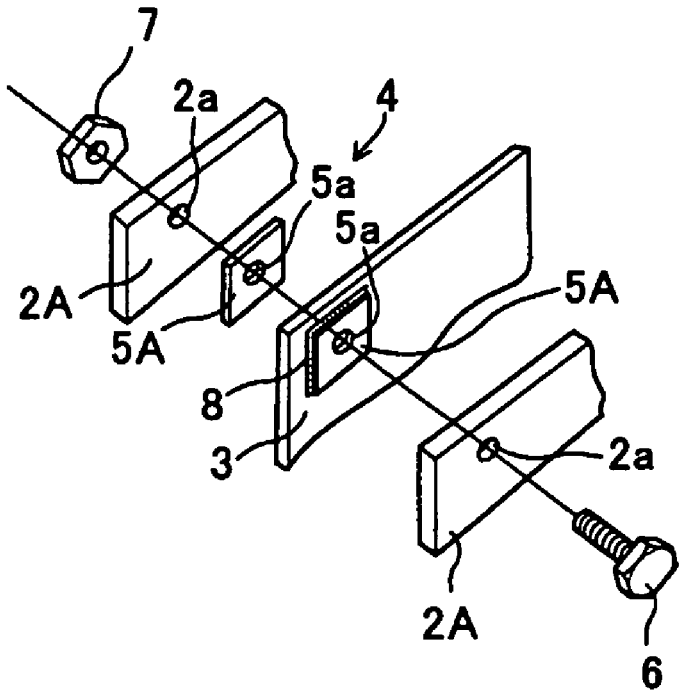
FIG. 3 is an exploded perspective view illustrating a slung supporting part of a dust collection electrode and a slung beam.
Figure 4:
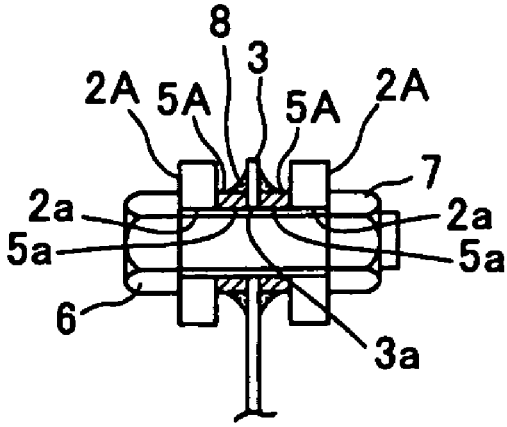
FIG. 4 is a cross-sectional view illustrating the slung supporting part of a dust collection electrode and a slung beam of this embodiment.
Figure 5:
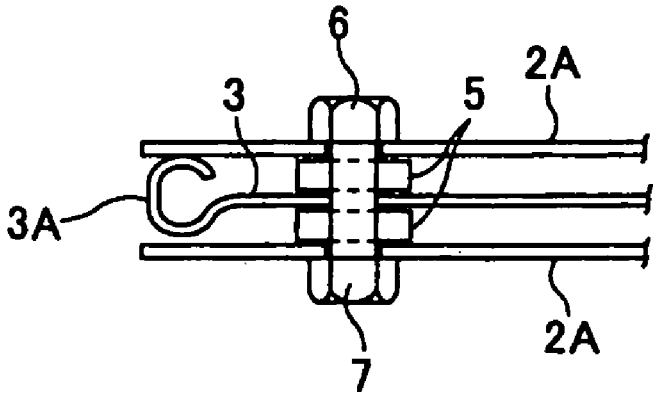
FIG. 5 is a partial plan view of this embodiment seen from the slung beam.

The following section will describe embodiments of the present invention with reference to the drawings. FIG. 1 to FIG. 5 illustrate a structure for attaching a dust collection electrode of a wet electric dust collector according to the first embodiment. FIG. 1 is a front view of the entirety of a dust collection electrode 1 in a wet electric dust collector. FIG. 2 is a partial front view. FIG. 3 is an exploded perspective view illustrating a slung supporting part of a dust collection electrode and a slung beam. FIG. 4 is a cross-sectional view illustrating the slung supporting part of a dust collection electrode and a slung beam. FIG. 5 is a partial plan view.

The dust collection electrode 1 of the wet electric dust collector is provided in a building. As shown in FIGS. 1 and 2, the dust collection electrode 1 is structured to include: a pair of upper and lower slung beams 2 that are slung in the lateral direction in the building and that are made of stainless material (super stainless material in particular); a plurality of dust collection electrode elements 3 that are arranged in a plane along the slung beams 2, that are made of super stainless, and that are slung and supported; and tightening means 4 by which the dust collection electrode elements 3 are slung from the slung beams 2.

As shown in FIGS. 3 and 4, the slung beam 2 is composed of a pair of beam pieces 2A consisting of long plates. The dust collection electrode element 3 is supported such that the upper and lower ends thereof are sandwiched by the beam pieces 2A from both faces and are slung. The beam pieces 2A include attachment holes 2*a*. The dust collection electrode element 3 includes attachment holes 3*a* that are arranged to be coaxial with the attachment holes 2*a* and through which the tightening means 4 penetrate (which will be described).

In this embodiment, a supporting member 5 made of Hastelloy® is attached to the dust collection electrode element 3, and the Hastelloy-made supporting member 5 is provided between the slung beam and the dust collection electrode plate so that the dust collection electrode plate elements 3 are slung and supported by the slung beam 2 while a distance being maintained therebetween. The supporting member 5 is composed of plate-like supporting plates 5A that are provided among the dust collection electrode elements 3 and both of the beam pieces 2A. This Hastelloy-made supporting member 5 includes attachment holes 5*a* that are opened so as to be coaxial with the attachment holes 2*a* and 3*a* opened in the slung beam 2 and the dust collection electrode element 3. While the dust collection electrode element 3 is being provided at the center and is being sandwiched between the pair of Hastelloy-made supporting plates 5A and the supporting plates 5A are being sandwiched between the beam pieces 2A, a bolt 6 is caused, by the tightening means composed of the bolt 6 and a nut 7, to penetrate these coaxially-arranged attachment holes 3*a*, 5*a*, and 2*a* and is tightened by the nut 7. The supporting plates 5A include the attachment holes 5*a* coaxially formed with the attachment holes 2*a* and 3*a*.

In this embodiment, the supporting plates 5A are made of Hastelloy and are welded to both faces of the dust collection electrode elements 3 by welding material 8 different from Hastelloy. Instead of welding or together with welding, resin material also can be used to fill the space.

Hastelloy is a registered trademark of Haynes International, Inc. and is material in which 60% of Ni includes Mo and Cr. Super stainless used for the dust collection electrode element 3 can be NAS254NM made by Nippon Yakin Kogyo Co., Ltd.

As shown in FIG. 5, the dust collection electrode element 3 is structured so that an end 3A is bent between the beam pieces 2A and is abutted between beam pieces 2A. This structure improves the rigidity of the end of the dust collection electrode element 3 to prevent the deflection of the dust collection electrode element 3.

The supporting plates 5A are flat plate members that have a thickness thick enough to fill the space of the hole penetrated by the bolt when the end 3A of the dust collection electrode element 3 is abutted to the beam pieces 2A. The supporting plates 5A are formed and arranged among the beam pieces 2A and the plate surfaces of the dust collection electrode element 3 so as to have a close contact therewith. This structure securely seals the spaces at the inner side of the beam pieces 2A opening to the holes 5*a*, 2*a*, and 3*a* penetrated by the bolt 6. This structure also allows the beam pieces 2A and the dust collection electrode element 3 made of the same material to be separated by the Hastelloy-made supporting plates 5A. Specifically, the contact part of the dust collection electrode element 3 attached to the slung beam 2 is made of Hastelloy and separates the assembled components from one another.

In the configuration as described above, the dust collection electrode element 3, the slung beam 2, and the supporting member 5 are exposed to the trapped mist of the cleaning water having a low pH value.

In particular, the entire face of the dust collection electrode element 3 is exposed to the mist. However, since the dust collection electrode element 3 is made of super stainless and thus is resistant to the entire face corrosion, thus preventing the entire face corrosion.

On the other hand, with regard to joint portions of the dust collection electrode element 3, the slung beam 2, and the supporting member 5, the portions among the supporting plates 5A, the slung beam 2, the dust collection electrode element 3, the bolt 6, and the nut 7 are exposed to the mist, respectively. The supporting plates 5A including the attachment holes 5*a* are made of Hastelloy and are welded to the dust collection electrode element 3, the spaces of the portion joined to the supporting plates 5A are sealed to be resistant to the hole corrosion, thus preventing the space corrosion and the hole corrosion.

Thus, this dust collection electrode 1 of the wet electric dust collector is resistant to the corrosion of the entire face, space, and hole. Thus, this dust collection electrode 1 can prevent all of the entire face corrosion, space corrosion, and hole corrosion.

Furthermore, high-cost Hastelloy is used only in the supporting plates 5A that tend to have the space corrosion and hole corrosion. Therefore, high-cost Hastelloy can be used in a smaller amount, thus reducing the manufacturing cost.

In the above embodiment, the slung beam 2 can be made of Hastelloy. Although this configuration requires a higher cost than in the case of the above embodiment, this configuration is advantageous in having higher resistance to the space corrosion and thus can be used for a longer period of time.

Figure 6:
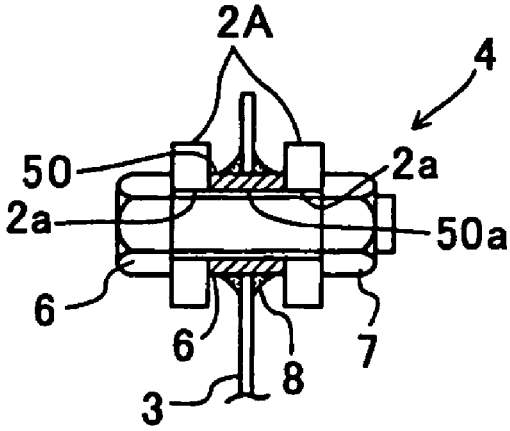
FIG. 6 is a cross-sectional view of the supporting structure illustrating an example of the second embodiment.

FIG. 6 is a cross-sectional view of the supporting structure illustrating an example of the second embodiment.

In this embodiment, the supporting member is not composed of a plate but by a Hastelloy-made cylindrical boss to function as a cylindrical boss-type supporting member 50. The supporting member 50 is formed to have a cylindrical length equal to the width of the above-described end 3A of the dust collection electrode element 3. This cylindrical boss-type supporting member 50 is arranged to penetrate the attachment hole 3*a* formed in the dust collection electrode element 3 and positions at which the supporting member 50 is joined to the dust collection electrode element 3 are welded by the welding material 8. The welding material 8 is made of resin or Hastelloy.

This supporting member 50 includes an attachment hole 50*a* that penetrates the attachment holes 2*a* of the beam pieces 2A and through which the bolt 6 penetrates.

In the second embodiment, the supporting member 50 is composed of only one cylindrical boss. This can not only reduce the number of components to be attached and attachment steps but also can eliminate a portion at which the dust collection electrode element 3 is joined to the bolt 6. Thus, reduced spaces or holes therebetween can, when combined with the supporting member 50 made of Hastelloy, prevent the space corrosion or hole corrosion.

Figure 7:
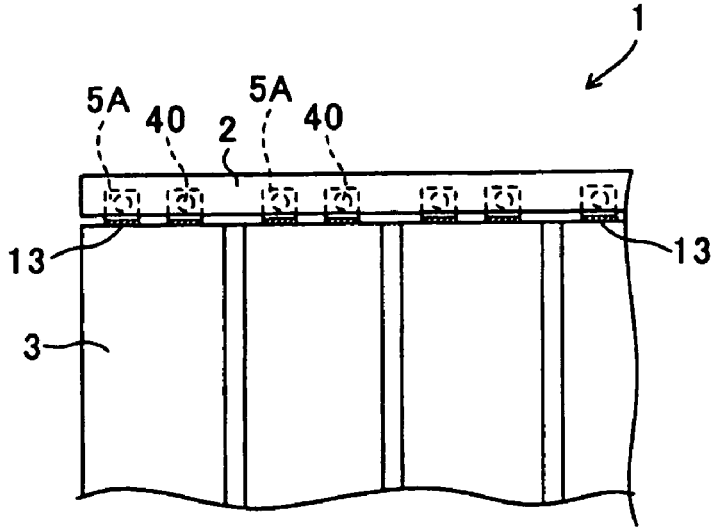
FIG. 7 is a front view of the entirety illustrating the third embodiment.
Figure 8:
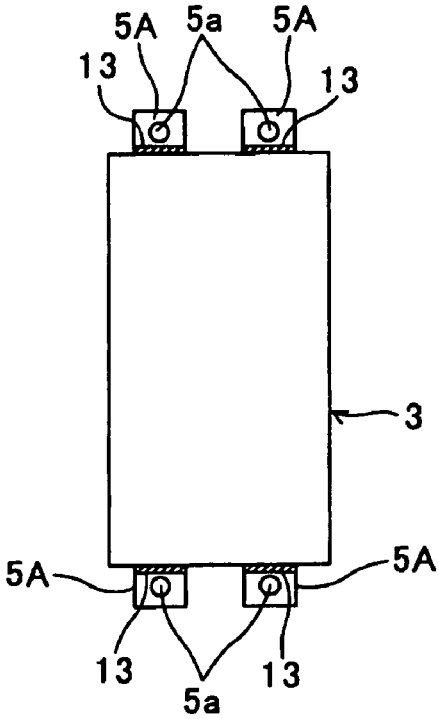
FIG. 8 is a partial front view of FIG. 7.

Next, FIG. 7 and FIG. 8 illustrate the third embodiment. FIG. 7 is a front view illustrating the entirety of the dust collection electrode. FIG. 8 is a partial front view of the dust collection electrode element.

In this third embodiment, the slung supporting member by the slung beam 2 of the dust collection electrode element 3 is formed only by a plate-like supporting plate 5. Specifically, instead of welding the supporting plate 5 of the first embodiment to the plate face of the dust collection electrode element 3, one end of the Hastelloy-made supporting plate 5 is welded to a plurality of positions of the upper and lower edges of the dust collection electrode element 3 (welded part 13) so that the supporting plate 5 is protruded to the outer side. This protruded Hastelloy-made supporting plate 5 is sandwiched by a pair of beam pieces 2A to form a three-layer structure and is tightened at the plurality of positions so that the dust collection electrode element 3 is slung via the Hastelloy-made supporting plate 5. The supporting plate 5 and the slung beam 2 are tightened together by a bolt and a nut (not shown) penetrating these attachment holes 2*a* and 5*a*. In particular, the dust collection electrode element 3 is configured as shown in FIG. 7 so as to be separated from the slung beam 2. Thus, the slung beam 2 and the dust collection electrode element 3 of the element slung supporting part are separated from each other by the Hastelloy-made supporting plate 5.

In this embodiment, the slung supporting portion of the dust collection electrode element 3 is formed only by the welded part 13. Thus, the dust collection electrode element 3 is prevented from being influenced by the space corrosion of the slung tightening portion. This configuration can reduce the material of the dust collection electrode element 3, thus reducing the material cost.

Figure 9:
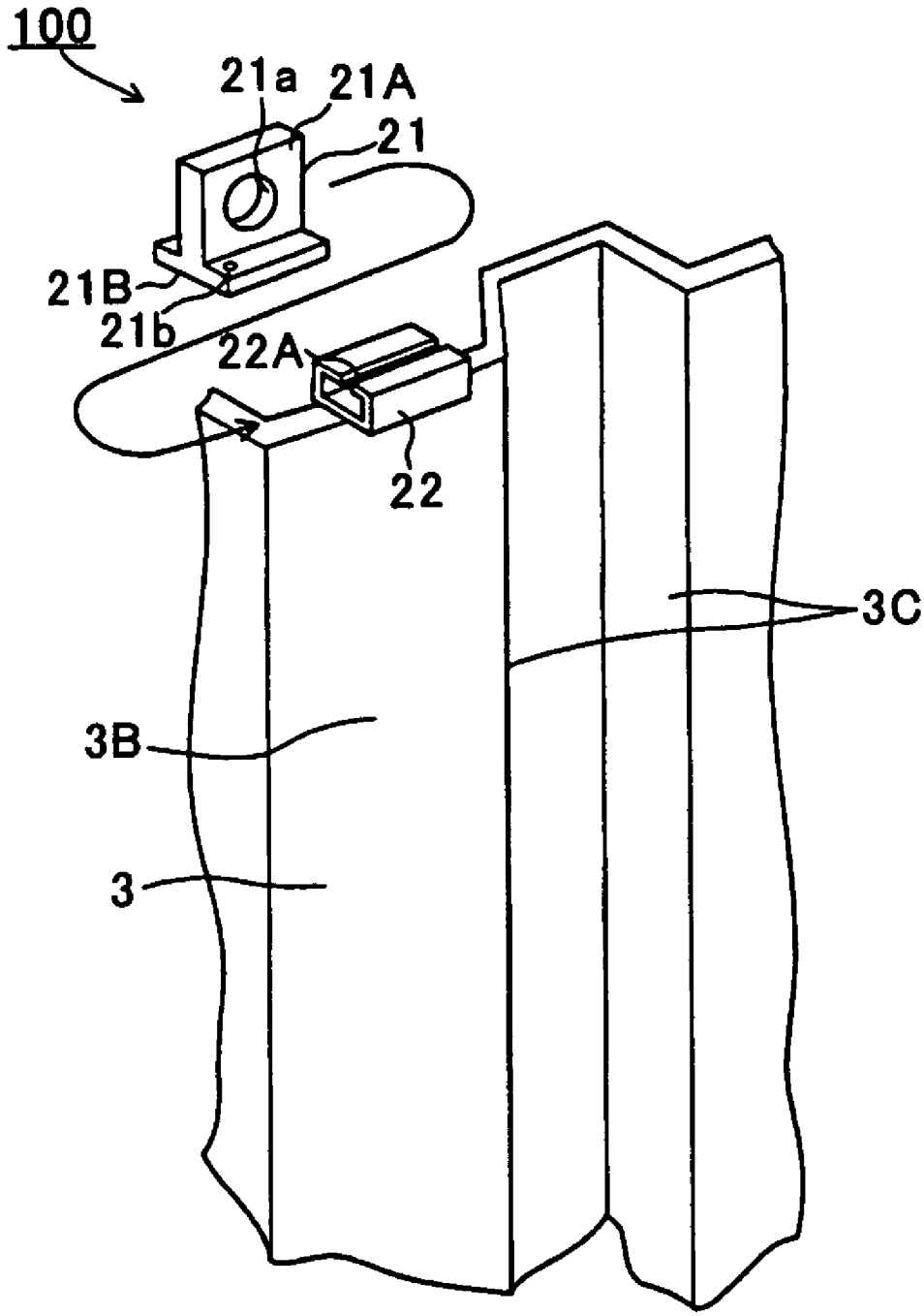
FIG. 9 is an exploded perspective view illustrating the fourth embodiment.

FIG. 9 is an exploded perspective view illustrating the fourth embodiment.

In this fourth embodiment, the supporting member is composed of a supporting member 100 having a removable mechanism. This supporting member 100 having a removable mechanism is provided at the upper and lower end faces of the dust collection electrode element 3. The supporting member 100 is composed of: a removable plate body 21 made of Hastelloy; and members 22 that are fixed to the upper and lower end faces of the dust collection electrode element 3 and that receive the plate body 21 inserted in the lateral direction.

In order to configure the removable mechanism, the plate body 21 is formed to have an inverted T-like shape obtained by integrating the lower end of a raised piece 21A with a base plate 21B. The raised piece 21A includes an attachment hole 21*a*. On the other hand, a receiving member 22 is formed by a C channel member having a rail groove 22A to which the base plate 21B of the plate body 21 can be inserted. The base plate 21B includes the attachment hole 21*b*. By tightening the attachment hole 21*b* and an attachment hole (not shown) formed in the plate body 21 by a bolt and a nut, the assembled respective components are prevented from being disengaged from one another.

In this configuration, a bottom plate 21B of the attachment plate 21 is inserted to the rail groove 22A of the receiving member 22 fixed to the upper and lower ends of the flat face section 3B of the dust collection electrode element 3. On the other hand, although not shown, both faces of the plate body 21 are sandwiched between the beam pieces 2A. By allowing the bolt 6 as a tightening means to penetrate the attachment holes 2*a* formed in beam pieces 2A and the attachment hole 21*a*, the attachment holes 2*a* formed in beam pieces 2A and the attachment hole 21*a* are tightened together by the nut 7.

Figure 10:
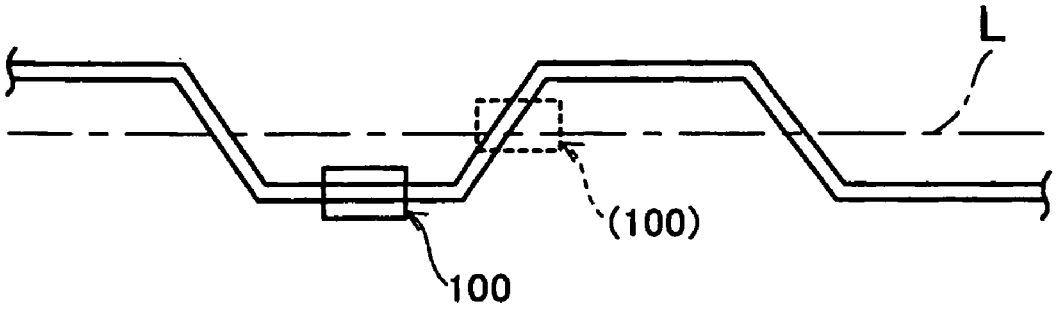
FIG. 10 is a plan view of FIG. 9.

The dust collection electrode element 3 is formed to have a wave-like shape in which concavity and convexity appear alternately. As shown in the solid line in a plan view of FIG. 10, the supporting member 100 may be attached to the upper and lower edges of the element flat face section 3B. Alternatively, as shown in the broken line in FIG. 10, the supporting member 100 also may be attached to the upper edge of the oblique plate section 3C of the dust collection electrode element 3 at a position along the element center line L. This arrangement along the center line L improves the weight balance when the dust collection electrode element 3 is slung.

In this fourth embodiment, the plate body 21 is directly joined to the slung beam 2 without using the dust collection electrode element 3 and is connected by a removable mechanism, thereby slinging the dust collection electrode element 3. By forming at least the plate body 21 by Hastelloy, the space and hole between the plate body 21 and the slung beam 2 can be resistant to the space corrosion and hole corrosion, thus preventing the space corrosion and hole corrosion thereof. Alternatively, the receiving member 22 used together with the slung beam 2 and the plate body 21 to form a pair also can be made of Hastelloy. Furthermore, the plate body 21 fixed to the rail groove 22A of the receiving member 22 also can provide a configuration that can be fixed securely and that yet can be disengaged because only one portion of the receiving member 22 and the attachment hole 21*b* is tightened. Thus, the dust collection electrode element 3 can be attached and detached easily.

Figure 11:
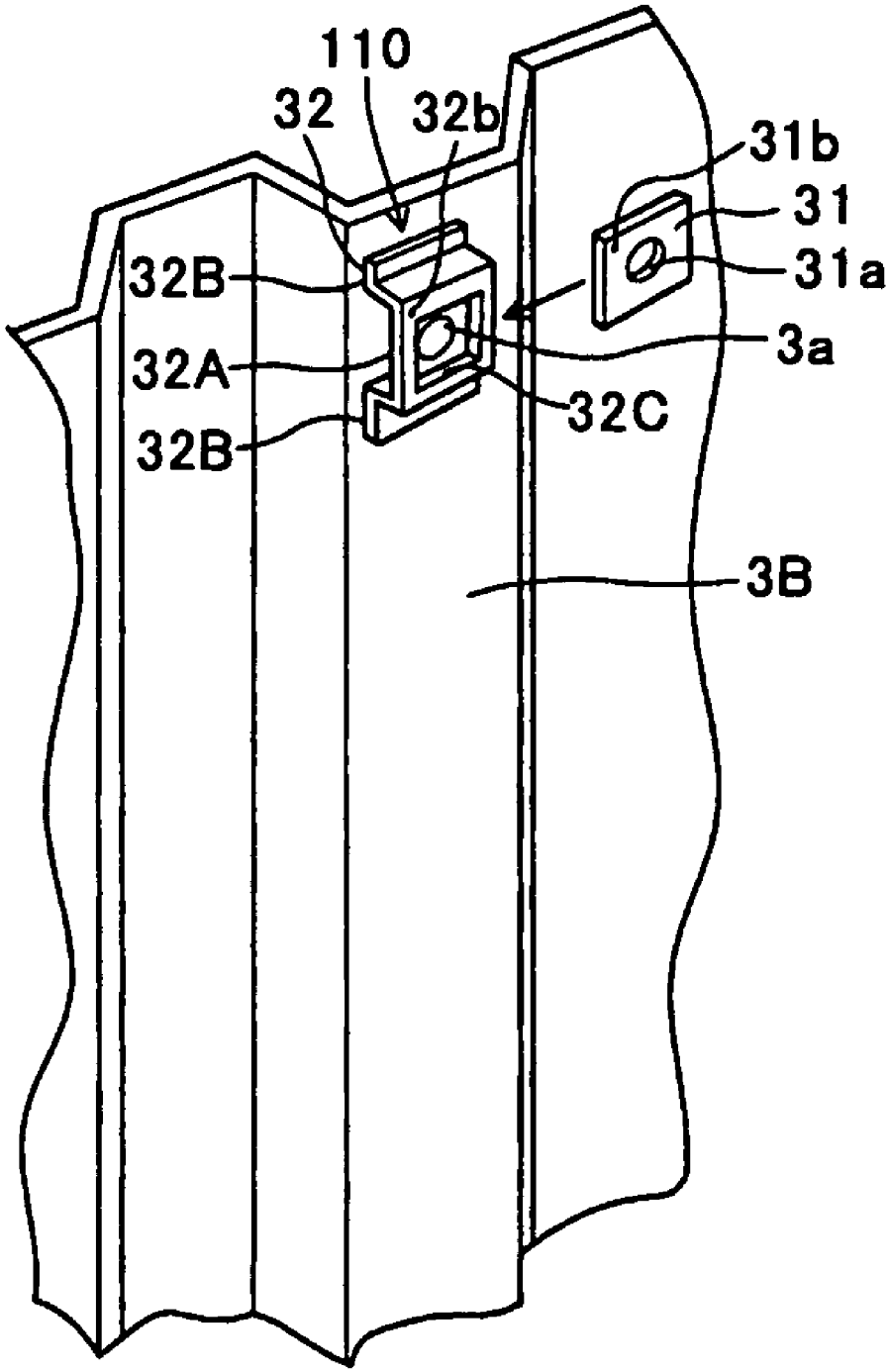
FIG. 11 is an exploded perspective view illustrating the fifth embodiment.

FIG. 11 is an exploded perspective view illustrating the fifth embodiment.

The supporting member 110 used in this embodiment is provided at the surface of the flat face section 3B of the dust collection electrode element 3. The supporting member 110 is composed of: the removable supporting plate 31 made of Hastelloy; and a saddle-like receiving member 32 that is fixed to the flat face section 3B of the dust collection electrode element 3 and to which the supporting plate 31 is inserted in the lateral direction. The supporting plate 31 is formed as a flat plate including the attachment hole 31a. On the other hand, the receiving member 32 includes a concave section 32A to which the supporting plate 31 can be inserted. Both ends of the concave section 32A have flanges 32B fixed to the flat face section 3B of the dust collection electrode element 3. The concave section 32A includes an opening section 32C through which the attachment hole 31*a* of the supporting plate 31 can be visually confirmed. The supporting plate 31 includes one attachment hole 31*b*. This one attachment hole 31*b* and the attachment hole 32*b* formed in the receiving member 32 are tightened by one bolt and one nut to tighten the components.

In this configuration, the supporting plate 31 is inserted to the concave section 32A of the receiving member 32 fixed to the upper and lower portions of the flat face section 3B of the dust collection electrode element 3. At the same time, although not shown, this supporting plate 31, the concave section 32A of the receiving member 32, and the dust collection electrode element 3 are sandwiched between the beam pieces 2A. The attachment holes 2*a* formed in the beam pieces 2A, the attachment hole 31*a* of the supporting plate 31, and the attachment hole 3*a* formed in the dust collection electrode element 3 are penetrated by the bolt 6 as a tightening means and are tightened by the nut 7.

In this fifth embodiment, the supporting plate 31 is made of Hastelloy. Thus, the space and hole between the supporting plate 31 and the dust collection electrode element 3, the receiving member 32, the bolt, and the nut joint to the supporting plate 31 can be resistant to the space corrosion and hole corrosion, thus preventing the space corrosion and hole corrosion therebetween. Furthermore, since the supporting plate 31 is fixed in the concave section 32A of the receiving member 32, not only secure fixation but also the tightening at one position of the receiving member 32 and the attachment hole 31*b* can cancel the fixation easily. Thus, the dust collection electrode element 3 can be attached and detached easily.

As can be seen from the above-described embodiment, the present invention can take the following embodiments.

1. A structure for attaching a dust collection electrode of a wet electric dust collector in which an end of a dust collection electrode plate made of stainless material is tightened at and is slung to be supported by a slung beam slung in a lateral direction in a building accommodating a dust collection apparatus, including:

a supporting member that is attached to the dust collection electrode plate and that is made of Hastelloy®;

a tightening means having attachment holes in the Hastelloy-made supporting member and the slung beam to tighten the Hastelloy-made supporting member and the slung beam together via the attachment holes, wherein the slung beam and the dust collection electrode plate have therebetween the Hastelloy-made supporting member to sling and support the dust collection electrode plate by the slung beam so that the slung beam and the dust collection electrode plate are separated from each other.

According to this configuration, all of the entire face corrosion, space corrosion, and hole corrosion can be prevented. At the same time, high-cost Hastelloy is used only in the supporting member having a contact with the slung beam. Therefore, high-cost Hastelloy can be used in a smaller amount, thus reducing the manufacturing cost.

2. The structure for attaching a dust collection electrode of a wet electric dust collector according to the above section 1, wherein the slung beam is made of Hastelloy.

This configuration can prevent all of the entire face corrosion, space corrosion, and hole corrosion of the slung beam.

3. The structure for attaching a dust collection electrode of a wet electric dust collector according to the above section 1, wherein the Hastelloy-made supporting member is formed as a plate member, both faces of edges of the dust collection electrode plate are joined and welded to the Hastelloy-made supporting member, these joint parts are sandwiched between the slung beams, and these sandwiched parts are penetrated by attachment holes and are tightened together by the tightening means.

Since the supporting member is formed as a plate member, the sandwiched parts can be tightened together easily and a corrosion prevention effect also can be provided appropriately.

4. The structure for attaching a dust collection electrode of a wet electric dust collector according to the above section 1, wherein the Hastelloy-made supporting member is formed as a cylindrical boss and is caused to penetrate the attachment hole of the dust collection electrode and is welded and an end face of the cylindrical boss is sandwiched between the slung beams and is tightened by the tightening means via a boss hole.

Since the supporting member is formed as the cylindrical boss penetrating and being welded to the dust collection electrode, only one supporting member can be required. This configuration not only can reduce the numbers of components to be attached and attachment steps but also can eliminate portions at which the dust collection electrode is joined to the slung beam and the dust collection electrode is joined to the bolt. Thus, the space or hole thereamong can be reduced. Thus, this configuration can, when being combined with the cylindrical boss supporting member made of Hastelloy, further prevent the space corrosion and hole corrosion.

5. The structure for attaching a dust collection electrode of a wet electric dust collector according to the above section 1, wherein the Hastelloy-made supporting member is welded to edges of the dust collection electrode plate to protrude to upper and lower sides, this protruding supporting plate is sandwiched between the slung beams and the protruding supporting plate and the slung beams are tightened together by the tightening means via the attachment holes penetrating the sandwiched part.

This configuration can reduce the material of the dust collection electrode, thus reducing the material cost.

6. The structure for attaching a dust collection electrode of a wet electric dust collector according to the above section 1, wherein the structure is composed of a plate body for sandwiching the Hastelloy-made supporting member between the slung beams and a receiving member of the plate body welded to an edge of the dust collection electrode plate, the plate body and the receiving member have therebetween a removable mechanism.

Since the dust collection electrode element is slung and supported only by the welded part, the dust collection electrode element can be prevented from being influenced by the space corrosion of the slung and tightened portion.

7. The structure for attaching a dust collection electrode of a wet electric dust collector according to the above section 1, wherein the receiving member facing the attachment hole is attached to an end plate face of the dust collection electrode plate, the Hastelloy-made supporting member having the attachment hole is attached to this receiving member, the dust collection electrode plate is sandwiched between the supporting members from the outer faces of the supporting members and the dust collection electrode plate and the supporting members are tightened together by the tightening means.

According to this configuration, component replacement can be simplified and the maintenance can be achieved with a lower cost.

8. The structure for attaching a dust collection electrode of a wet electric dust collector according to the above section 1, wherein the supporting member is surrounded by a resin sealing section to seal the supporting member.

Since the supporting member is surrounded by the resin sealing section to seal the supporting member, a space or hole between the supporting member and the dust collection electrode can be eliminated. Thus, this configuration can, when being combined with the supporting member made of Hastelloy, further prevent the space corrosion or hole corrosion around the supporting member.

FIG. 1

1 Dust collection electrode
2 Slung beam
3 Dust collection electrode element
4 Tightening means
5 Supporting member

The invention claimed is:

1. A structure for attaching a dust collection electrode of a wet electric dust collector in which an end of a dust collection electrode plate made of stainless material is tightened at and is slung to be supported by a slung beam slung in a lateral direction in a building accommodating a dust collection apparatus, comprising:

a supporting member that is attached to the dust collection electrode plate and that is made of Hastelloy®; and a tightening means having attachment holes in the Hastelloy-made supporting member and the slung beam to tighten the Hastelloy-made supporting member and the slung beam together via the attachment holes, wherein the slung beam and the dust collection electrode plate have therebetween the Hastelloy-made supporting member to sling and support the dust collection electrode plate by the slung beam so that the slung beam and the dust collection electrode plate are separated from each other.

2. The structure for attaching a dust collection electrode of a wet electric dust collector according to claim 1, wherein the slung beam is made of Hastelloy.

3. The structure for attaching a dust collection electrode of a wet electric dust collector according to claim 1, further comprising a plurality of said slung beams, wherein the Hastelloy-made supporting member is formed as a plate member, both faces of edges of the dust collection electrode plate are joined and welded to the Hastelloy-made supporting member, these joint parts are sandwiched between the slung beams, and these sandwiched parts are penetrated by attachment holes and are tightened together by the tightening means.

4. The structure for attaching a dust collection electrode of a wet electric dust collector according to claim 1, further comprising a plurality of said slung beams, wherein the Hastelloy-made supporting member is formed as a cylindrical boss and is caused to penetrate the attachment hole of the dust collection electrode and is welded and an end face of the cylindrical boss is sandwiched between the slung beams and is tightened by the tightening means via a boss hole.

5. The structure for attaching a dust collection electrode of a wet electric dust collector according to claim 1, further comprising a plurality of said slung beams, wherein the Hastelloy-made supporting member is welded to edges of the dust collection electrode plate to protrude to upper and lower sides, this protruding supporting plate is sandwiched between the slung beams and the protruding supporting plate and the slung beams are tightened together by the tightening means via the attachment holes penetrating the sandwiched part.

6. The structure for attaching a dust collection electrode of a wet electric dust collector according to claim 1, further comprising a plurality of said slung beams, wherein the structure is composed of a plate body for sandwiching the Hastelloy-made supporting member between the slung beams and a receiving member of the plate body welded to an edge of the dust collection electrode plate, the plate body and the receiving member have therebetween a removable mechanism.

7. The structure for attaching a dust collection electrode of a wet electric dust collector according to claim 1, further comprising a plurality of said slung beams, wherein a receiving member facing the attachment hole is attached to an end plate face of the dust collection electrode plate, the Hastelloy-made supporting member having the attachment hole is attached to this receiving member, the dust collection electrode plate is sandwiched between the supporting members from the outer faces of the supporting members and the dust collection electrode plate and the supporting members are tightened together by the tightening means.

8. The structure for attaching a dust collection electrode of a wet electric dust collector according to claim 1, wherein the supporting member is surrounded by a resin sealing section to seal the supporting member.

* * * * *